US006225735B1

(12) United States Patent
Nakagawa et al.

(10) Patent No.: US 6,225,735 B1
(45) Date of Patent: May 1, 2001

(54) SHADOW MASK FOR COLOR CATHODE-RAY TUBE AND METHOD OF MANUFACTURING THE SAME

(75) Inventors: Shinichiro Nakagawa, Fukaya; Shinji Ohama, Hyogo-ken; Norio Shimizu, Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/125,388

(22) PCT Filed: Dec. 18, 1997

(86) PCT No.: PCT/JP97/04688

§ 371 Date: Aug. 18, 1998

§ 102(e) Date: Aug. 18, 1998

(87) PCT Pub. No.: WO98/27574

PCT Pub. Date: Jun. 25, 1998

(30) Foreign Application Priority Data

Dec. 18, 1996 (JP) ..... 8-338056

(51) Int. Cl.[7] ..... H01J 29/80; H01J 9/236

(52) U.S. Cl. ..... 313/407; 445/37; 445/47

(58) Field of Search ..... 313/402, 404, 313/406, 407; 445/36, 37, 47, 68

(56) References Cited

U.S. PATENT DOCUMENTS 4,746,315 * 5/1988 Sumiyoshi et al. ..... 445/37
5,041,756 8/1991 Fairbanks ..... 313/407
5,216,321 6/1993 Kawamura et al. ..... 313/479
5,634,838 * 6/1997 Egami et al. ..... 445/30
5,917,273 * 6/1999 Watanabe et al. ..... 313/402
6,025,676 * 2/2000 Ohama et al. ..... 313/477 R

FOREIGN PATENT DOCUMENTS 2 177 627 1/1987 (GB) .

* cited by examiner

*Primary Examiner*—Michael H. Day
*Assistant Examiner*—Michael J. Smith
(74) *Attorney, Agent, or Firm*—Pillsbury Madison & Sutro Intellectual Property Group

(57) ABSTRACT

A shadow mask is arranged to face an inner surface of a substantially rectangular face panel. The shadow mask has a substantially rectangular mask body which has a number of apertures for passing an electron beam, and a rectangular mask frame which supports a peripheral edge portion of the mask body. The mask body is curved in a short axis direction, and is fixed to the mask frame in a state that an internal stress of a direction making small a radius of curvature of the short axis direction is applied. The shadow mask is manufactured in a manner that a rectangular flat mask is-plastically deformed so as to prepare the mask body having a curved surface such that a relation between a radius of curvature Rc of the short axis direction in the vicinity of the long axis and a radius of curvature Ra of the short axis direction in the vicinity of a long side becomes Rc<Ra, and thereafter, the mask body is fixed to the mask frame in a state of being elastically deformed in a direction in which a radius of curvature of the short axis direction becomes large.

4 Claims, 2 Drawing Sheets

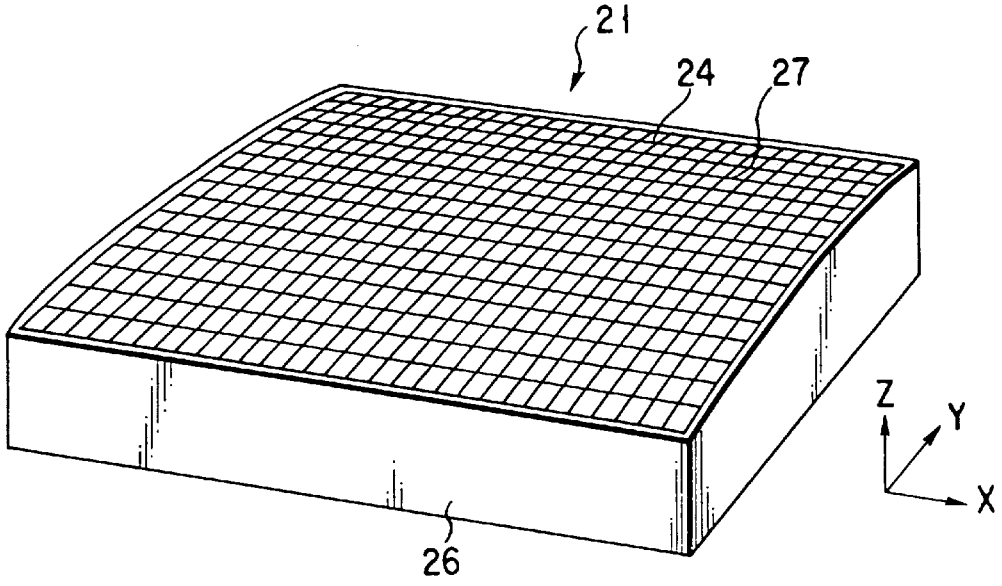
FIG. 3
FIG. 4A
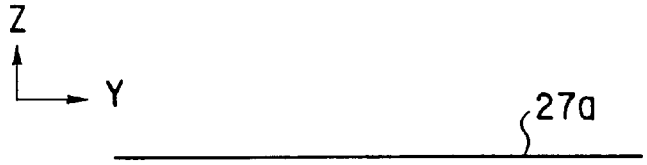
FIG. 4B
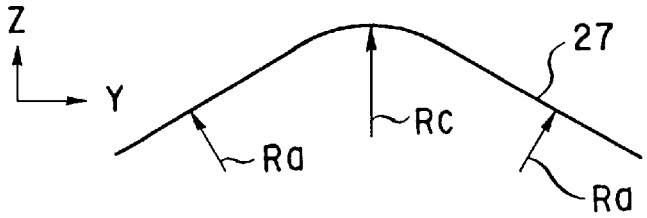
FIG. 4C
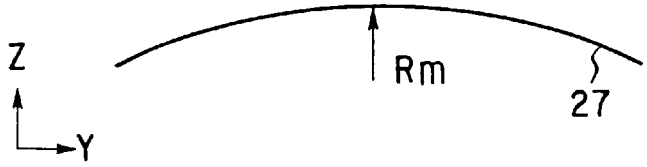

SHADOW MASK FOR COLOR CATHODE-RAY TUBE AND METHOD OF MANUFACTURING THE SAME

TECHNICAL FIELD

The present invention relates to a color cathode-ray tube including a shadow mask and a method of manufacturing the same.

BACKGROUND ART

In general, a color cathode-ray tube includes a vacuum envelope which has a substantially rectangular face panel having a curved effective portion, and a funnel which has a cylindrical neck portion at its one end and is joined together with the face panel. Further, a substantially rectangular shadow mask is arranged on the inner side of the phosphor screen which is formed on the inner surface of the effective portion and includes three-color phosphor layers.

An electron gun is arranged in the neck portion of the funnel. Three electron beams emitted from the electron gun are deflected by a magnetic field generated from a deflector (deflection yoke) mounted outside the funnel, and horizontally and vertically scan the phosphor screen through the shadow mask, and thereby displaying a color image.

The shadow mask includes a substantially rectangular mask body which is formed with a number of electron beam passing apertures at a surface facing the phosphor screen and has a plate thickness of about 0.1 to 0.3 mm, and a substantially rectangular mask frame which is fixed to an outer peripheral portion of the mask body. In general, the surface of the mask body on which the electron beam passing apertures are formed is constructed as a curved surface such that at least central portion thereof projects toward the phosphor screen so as to correspond to the shape of the inner surface of the effective portion of the face panel. As a shape of the curved surface, in the prior art, there are a spherical surface, a cylindrically curved surface which has a radius of curvature in a short axis direction thereof being approximately infinity and is curved in a long axis direction thereof, a curved surface represented by a high-order polynomial expression, etc.

Meanwhile, the methods of forming the curved surface of the shadow mask include a press forming method and a method of forming a curved surface by applying a tension.

The press forming method is a method of plastically deforming a flat plate like shadow mask made of a metallic thin plate having a number of electron beam passing apertures into a desired shape by press working. This method is employed mainly to form a shadow mask having a spherical surface or a curved surface represented by a high-order polynomial expression.

The method of forming a curved surface by applying a tension is employed mainly to form a cylindrically curved surface which has a radius of curvature in a short axis direction thereof being approximately infinity and is curved in a long axis direction thereof. According to this method, a flat plate like shadow mask, which is made of a metallic thin plate having a number of electron beam passing apertures formed thereon, is curved so as to face a frame having a mask body attachment surface which has a radius of curvature of the short axis direction being approximately infinity and is curved in the long axis direction, and then, the flat plate like shadow mask is fixed to the frame in a state that a tension is applied in the short axis direction, and thereby, a shadow mask having a desired shape being formed.

Recently, in a color cathode-ray tube, the effective portion of the face panel is made flat in order to improve a visibility of the screen. With the flatness of the face panel, the curved surface of the shadow mask is made flat, and also, the curvature thereof is becoming smaller.

In the case where the shadow mask which is made flat is formed by the aforesaid press forming, since the curvature thereof is small, a curved surface holding strength of the shadow mask becomes low. As a result, if an external force such as impact or the like is applied to the color cathode-ray tube, the curved surface portion of the shadow mask is liable to be deformed. Further, if a vibration is applied to the color cathode-ray tube, the shadow mask is liable to be resonated (howling). This causes a deterioration in a color purity of a displayed image.

Also, in the case of locally displaying a high luminance image, the shadow mask is locally heated by a collision of high-density electron beams, and is locally bulged into the phosphor screen direction; namely, a so-called doming is liable to occur. If the aforesaid doming occurs, in particular, the electron beams do not properly land at a predetermined phosphor layers on an intermediate area of the screen, causing a deterioration in a color purity, likewise above.

The curved surface holding strength of the flattened shadow mask can be improved by making thick a plate thickness of the shadow mask. If the plate thickness of the shadow mask is thickened, however, not only it is difficult to form a electron beam passing apertures having a desired shape and dimension, but also a material cost increases.

On the other hand, the method of forming a curved surface by applying a tension is a method of applying a tensile stress to the shadow mask by applying a tension to a short axis direction in which a radius of curvature is approximately infinity. For this reason, a radius of curvature of a long axis direction is made large, and the curved surface of the shadow mask can be easily flattened. Further, a predetermined curved surface holding strength can be given to the shadow mask.

According to this method, however, an extremely great tensile stress must be applied to the shadow mask; for this reason, an extremely strong frame for holding the shadow mask is required. Consequently, with the color cathode-ray tube being large-sized, a weight of the frame is greatly increased.

In order to solve the above problems, there has been proposed a method of forming the curved surface of the shadow mask into a substantially cylindrically curved shape which has a radius of curvature in the long axis direction being approximately infinity and is curved in the short axis direction or a shape represented by a high-order polynomial expression. Further, in order to manufacture the aforesaid shadow mask, there has been proposed a method comprising the steps of bending a flat plate shadow mask made of a. metallic thin plate so as to have a curvature in only short axis direction, plastically deforming the shadow mask into a cylindrically curved shape (circular arc), elastically deforming the shadow mask so that a predetermined curved surface having a radius of curvature larger than the above curvature, and fixing the shadow mask to the frame.

According to this method, an elastic force of making small the radius of curvature, that is, a stress of improving a curved surface holding strength is applied to the shadow mask. Therefore, the curved surface holding strength of the shadow mask can be improved.

However, the shadow mask as described above has a problem that the curved surface holding strength of the shadow mask is low at the portions which are close to the long axis of the shadow mask if the shadow mask is made a large scale accompanying with a large scale of a color cathode-ray tube.

DISCLOSURE OF INVENTION

The present invention has been contrived in consideration of the above mentioned circumstances, and it object is to provide a color cathode-ray tube which has a sufficient curved surface holding strength of a shadow mask even if the shadow mask is flattened in accordance with a flatness of the effective portion of a face panel, and a method of manufacturing the same.

To achieve the above object, a color cathode-ray tube according to the present invention comprises:

a face panel including a substantially rectangular effective portion having a long axis and a short axis which are perpendicular to each other;

a phosphor screen formed on an inner surface of the face panel;

a shadow mask arranged so as to face the phosphor screen; and an electron gun for emitting an electron beam to the phosphor screen through the shadow mask;

the shadow mask including a substantially rectangular mask body which is formed with a number of apertures for passing the electron beam and which has a long axis and a short axis individually corresponding to the long axis and the short axis of the face panel, and a rectangular mask frame which supports a peripheral edge portion of the mask body, the mask body being curved in a short axis direction and being fixed to the mask frame in a state that an internal stress in a direction making small a radius of curvature in the short axis direction is applied.

With the color cathode-ray tube, a stress applied to the mask body can be kept substantially constant in the region of the mask body between the long axis and each of end portions in the short axis direction thereof. Further, an internal stress of a direction of making small the radius of curvature of the mask body remains in the region of the mask body vicinity of the long axis, so that the curved surface holding strength of the mask body can be improved. Thus, it is possible to greatly restrict a shift in electron beam landing resulting from deformation or resonance of the mask body when an external force such as impact or the like is applied to the shadow mask, local doming or the like. Therefore, the present invention can provide a color cathode-ray tube which is capable of displaying an image having preferably color purity.

Further, the present invention provides a method of manufacturing a color cathode-ray tube which comprises a face panel including a substantially rectangular effective portion having a long axis and a short axis which are perpendicular to each other; a phosphor screen formed on an inner surface of the face panel; a shadow mask arranged so as to face the phosphor screen; and an electron gun for emitting an electron beam to the phosphor screen through the shadow mask; the shadow mask including a substantially rectangular mask body which is formed with a number of apertures for passing the electron beam and which has a long axis and a short axis individually corresponding to the long axis and the short axis of the face panel, and a rectangular mask frame which supports a peripheral edge portion of the mask body, the method comprising the steps of:

preparing a mask material formed of a flat plate on which a number of apertures are formed;

plastically deforming the mask material so as to have a curved surface such that a relation between a radius of curvature Rc in the short axis direction at the region vicinity of the long axis of the mask material and a radius of curvature Ra in the short axis direction at the region vicinity of each of long sides of the mask material becomes $Rc<Ra$, thereby forming a mask body;

elastically deforming the plastically deformed mask body so as to have a curved surface such that a radius of curvature in the short axis direction is larger than the radius of curvature Rc and is constant in the short axis direction; and fixing the elastically deformed mask body to the mask frame.

In accordance with the above method, the mask body is fixed to the mask frame in a state that an internal stress in a direction of making small the radius of curvature of the mask body remains in that region of the mask body which is vicinity of the long axis, so that the curved surface holding strength of the mask body can be improved. Whereby it is possible to greatly restrict a shift in electron beam landing resulting from deformation or resonance of the mask body, local doming or the like. Therefore, the present invention can manufacture a color cathode-ray tube which is capable of displaying an image having preferably color purity.

BRIEF DESCRIPTION OF DRAWINGS

FIG. 3 is a perspective view showing a shadow mask, in which a number of matrix-like lines are marked on the surface of a mask body so that a curved surface shape of the mask body can be further clarified; and FIG. 4A to FIG. 4C are individually cross-sectional views schematically showing a process for manufacturing a mask body of the shadow mask.

BEST MODE OF CARRYING OUT THE INVENTION

Referring now to the accompanying drawings, a color cathode-ray tube according to an embodiment of the present invention will be described in detail.

Figure 1:
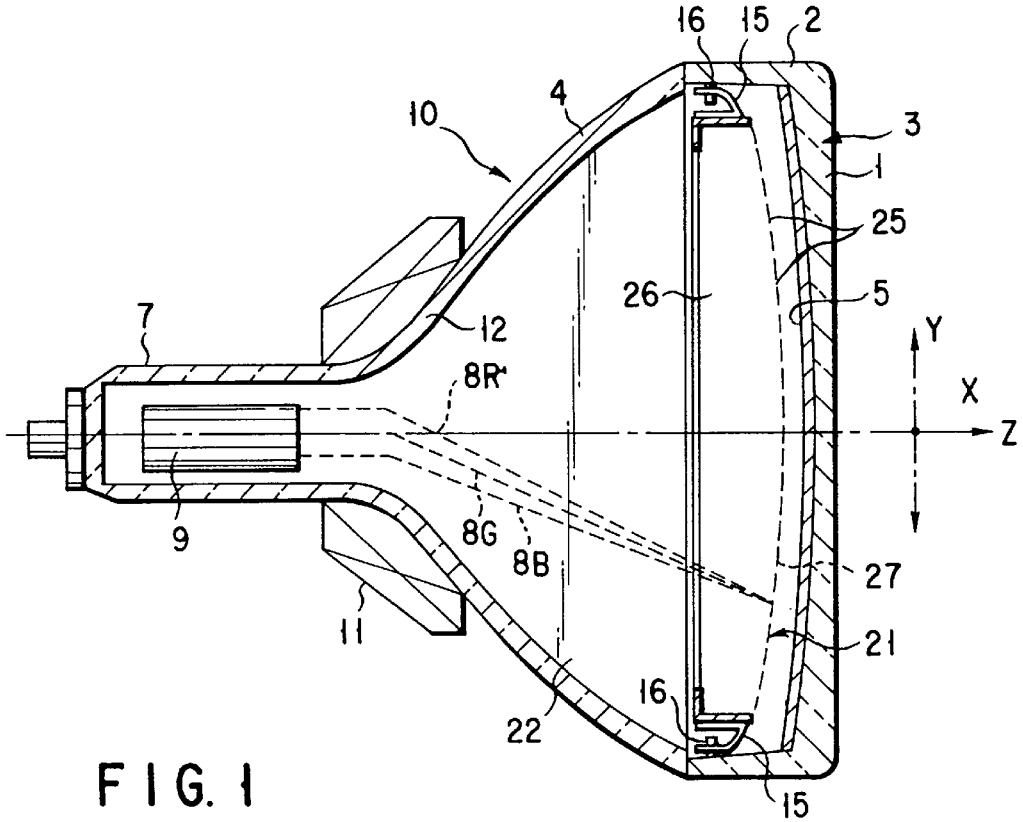
FIG. 1 is a cross-sectional view showing a color cathode-ray tube according to an embodiment of the present invention.
Figure 2:
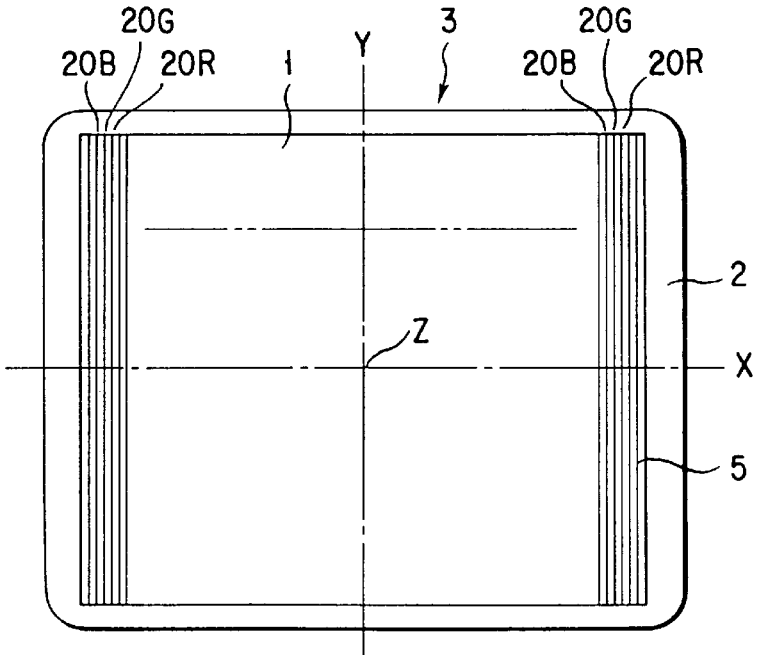
FIG. 2 is a front view showing an inner surface side of the color cathode-ray tube.

As shown in FIG. 1 and FIG. 2, there is shown a color cathode-ray tube. This color cathode-ray tube is a laterally long color cathode-ray tube which has a screen aspect ratio of 16:9, and includes a vacuum envelope 10 made of glass. The vacuum envelope 10 is formed of a face panel 3 which has a substantially rectangular effective portion 1 and a skirt portion 2 formed on the periphery of the effective portion 1, a funnel 4 joined to the skirt portion 2, and a cylindrical neck portion 7 extending from the funnel 4.

The effective portion 1 of the face panel 3 is formed into a substantially rectangular shape having a long axis (horizontal axis) X and a short axis (vertical axis) Y which pass through the tube axis Z of the cathode-ray tube and are perpendicular to each other. Further, an inner surface of the effective portion 1 is an aspherically concave curved surface. On the inner surface of the effective portion 1 is formed a phosphor screen 5 which comprises stripe-shaped three-color phosphor layers 20B, 20G and 20R which are respectively luminescent blue, green and red, and stripe-shaped light shading layers 23 formed between these phosphor material layers. The phosphor layers 20B, 20G and 20R extend parallel with the short axis Y and are arranged in the long axis X direction.

A substantially rectangular shadow mask 21 is arranged in the vacuum envelope 10 so as to face to the phosphor screen 5. As will be described later, the shadow mask 21 includes a mask body 27 having a number of apertures 25, and a mask frame 26 supporting a peripheral edge portion of the mask body 27. Further, the shadow mask 21 is supported onto the face panel 3 in a manner of engaging a substantially wedge-like elastic support members 15 fixed to side walls of the mask frame 26 to stud pins 16 projecting from an inner surface of the skirt portion of the face panel 3, respectively. Therefore, the mask body 27 faces the phosphor screen 5 with a predetermined distance.

In the neck portion 7 is arranged an electron gun 9 which emits three electron beams 8B, 8G and 8R toward the phosphor screen 5. The color cathode-ray tube having the aforesaid construction displays a color image in the following manner. Specifically, three electron beams 8B, 8G and 8R emitted from the electron gun 9 are deflected by horizontal and vertical magnetic fields generated from a deflection yoke 11 mounted on the outside of the funnel 4, and then, horizontally and vertically scan the phosphor screen 5 through the shadow mask 21, and thus, a color image is displayed.

As shown in FIGS. 1 and 3, the shadow mask 21 includes a substantially rectangular mask body 27 which is arranged so as to face the phosphor screen 5 and on which a number of apertures 25 for passing electron beams are formed, and a substantially rectangular mask frame 26 which is fixed on an outer peripheral portion of the mask body 27. The mask frame 26 has the same profile as that of the shadow mask 21, and the mask body 27 is fixed to an inner circumferential edge portion of the mask frame 26.

The mask body 27 has a long axis (horizontal axis) X and a short axis (vertical axis) Y which passing through the tube axis Z and are perpendicular to each other, so as to correspond to the effective portion 1 of the face panel 3. Further, the mask body 27 constitutes a substantially cylindrically curved surface 24 which has a radius of curvature in the long axis direction being infinity and is curved in the short axis direction. Moreover, the mask body 27 is fixed to the mask frame 26 in a state that an internal stress in a direction of making small the radius of curvature in the short axis direction is applied to the curved surface 24, that is, in a state that the curved surface 24 is held by an internal stress such that the central portion of the curved surface 24 returns to the aoriginal curved surface having a large curvature.

A decision whether or not the internal stress remains in the shadow mask 21 is made in the following manner. Specifically, the decision is made on the basis of the fact whether when removing the mask body 27 from the mask frame 26, the radius of curvature in the short axis direction of the removed mask body 27 returns to or is close to the original radius of curvature before the mask body 27 is fixed to the mask frame 26.

The shadow mask 21 as described above is manufactured according to the following processes.

First, a number of apertures 25 are formed on a predetermined area of a thin rectangular metal plate having a thickness of 0.10 to 0.30 mm by a photoetching method, and then, a rectangular flat mask (mask material) 27*a* as shown in FIG. 4A is formed.

Next, the flat mask 27*a* is subjected to bending with use of a roller or the like so as to be plastically deformed. By doing so, as shown in FIG. 4B, there can be obtained a mask body 27 which is curved in only short axis Y direction and in which a radius of curvature Rc in the vicinity of the long axis X and a radius of curvature Ra in the vicinity of end portions (long side portions) in the short axis direction are different from each other, and a relation of Rc<Ra is established.

Subsequently, as shown in FIG. 4C, the plastically deformed mask body 27 is elastically deformed in a direction in which the radius of curvature in the short axis Y direction becomes small, and thereby, is formed into a substantially cylindrically shape. And then, the mask body 27 which is kept in the elastically deformed state is fixed to the mask frame 26. By doing so, the mask body 27 is fixed to the mask frame 26 in a state that an internal stress is applied in a direction in which the radius of curvature in the short axis direction becomes small.

In the case where the flat mask 27*a* is plastically deformed, the radius of curvature Rc and Ra are set so that a substantially cylindrically shape having a predetermined radius of curvature Rm is defined when the plastically deformed mask body 27 is fixed to the mask frame 27 while being elastically deformed in the short axis direction.

In the case of manufacturing the color cathoderay tube, the shadow mask 21 manufactured as described above is combined with the face panel 3, and with use of the shadow mask as an optical mask, the phosphor screen 5 is formed on the inner surface of the effective portion 1 of the face panel 3 by a photoprinting method. Next, the shadow mask 21 is mounted to the face panel 3 on which the phosphor screen is formed, and then, the face panel 3 and the funnel 4 are integrally joined (sealed) together so that a vacuum envelope 10 is prepared. Subsequently, the electron gun 9 is sealed in the neck portion 7 of the funnel 4, and thereafter, the exterior of the vacuum envelope 10 is exhausted, and thus, the color cathode-ray tube can be manufactured.

In the color cathode-ray tube constructed as described above, the curved surface of the mask body 27 is previously plastically deformed so that the radius of curvature Rc in the vicinity of the long axis X and the radius of curvature Ra in the vicinity of the long side portions has a relation of Rc<Ra. And then, the mask body 27 is fixed to the mask frame 26 having a fixing edge portion which is the same shape as the profile of the finally required shadow mask 21, in a state of being elastically deformed so as to form a cylindrically curved surface having a predetermined radius of curvature. Whereby the mask body 27 is fixed to the mask frame 26 in a state that the internal stress for maintaining a predetermined curved surface holding strength remains therein.

In this manner, a stress applied to the mask body 27 can be kept substantially constant over the peripheral side portions of the mask body 27 from the vicinity of the long axis thereof. Further, the mask body 27 is plastically deformed, and thereafter, is elastically deformed in a direction in which its radius of curvature becomes small, and thus, is fixed to the mask frame 26. For this reason, an internal stress of making small the radius of curvature of the mask body 27 is applied to the vicinity of the long axis thereof. Therefore, a curved surface holding strength of the mask body 27 can be improved by the internal stress.

The shadow mask constructed as described above was actually manufactured, and then, the curved surface holding strength was measured. As a result, according to the shadow mask of the present embodiment, in a state before the shadow mask is fixed to a mask frame, it was found that the curved surface holding strength of the shadow mask was greatly improved as compared with a shadow mask having a substantially cylindrical shape such that the radius of curvature of the short axis direction is constant over the whole surface thereof.

Consequently, if an external force such as impact, vibration or the like is applied to the color cathode-ray tube, it is possible to greatly restrict a shift in electron beam landing resulting from deformation of the mask body, resonance, local doming or the like. Therefore, the present invention can provide a color cathode-ray tube which is capable of displaying an image having preferably chromatic purity.

The present invention is not limited to the aforesaid embodiment, and various changes and modifications can be made within a scope of the present invention. For example, the radius of curvature of the long axis direction of the mask body is infinity. As the need arises, the mask body may be curved in the long axis direction.

What is claimed is:

1. A color cathode-ray tube comprising:

a face panel including a substantially rectangular effective portion having a long axis and a short axis which are perpendicular to each other;

a phosphor screen formed on an inner surface of the face panel;

a shadow mask arranged so as to face the phosphor screen; and an electron gun for emitting an electron beam toward the phosphor screen through the shadow mask;

the shadow mask including a substantially rectangular mask body which is formed with a number of apertures for passing the electron beam and which has a long axis and a short axis individually corresponding to the long axis and the short axis of the face panel, and a rectangular mask frame which supports a peripheral edge portion of the mask body, the mask body being curved in the short axis direction and being fixed to the mask frame in a state that an internal stress in a direction of making small a radius of curvature in the short axis direction is applied mainly in that region of the mask body which is in the vicinity of the long axis.

2. A color cathode-ray tube according to claim 1, wherein the mask body has a substantially cylindrically curved shape in which a radius of curvature in the long axis direction is infinity.

3. A method of manufacturing a color cathode-ray tube which comprises a face panel including a substantially rectangular effective portion having a long axis and a short axis which are perpendicular to each other; a phosphor screen formed on an inner surface of the face panel; a shadow mask arranged so as to face the phosphor screen; and an electron gun for emitting an electron beam toward the phosphor screen through the shadow mask; the shadow mask including a substantially rectangular mask body which is formed with a number of apertures for passing the electron beam and which has a long axis and a short axis individually corresponding to the long axis and the short axis of the face panel, and a rectangular mask frame which supports a peripheral edge portion of the mask body;

the method comprising the steps of:

preparing a flat plate like mask material on which a number of apertures are formed;

plastically deforming the mask material so as to form a mask body having a curved surface such that a relation between a radius of curvature Rc in the short axis direction at the region which is in the vicinity of the long axis of the mask material and a radius of curvature Ra in the short axis direction at those regions which are in the vicinity of long sides of the mask material becomes $Rc<Ra$;

elastically deforming the plastically deformed mask body so as to have a curved surface such that a radius of curvature in the short axis direction is larger than the radius of curvature Rc and is constant in the short axis direction; and fixing the elastically deformed mask body to the mask frame.

4. A method according to claim 3, wherein in the step of plastically deforming the mask material, the mask material is plastically deformed so that a radius of curvature in the long axis direction becomes infinite.

* * * * *